US009979065B2

(12) United States Patent
Xu

(10) Patent No.: US 9,979,065 B2
(45) Date of Patent: May 22, 2018

(54) FILTER, COMMUNICATIONS APPARATUS, AND COMMUNICATIONS SYSTEM

(71) Applicant: Huawei Technologies Co., Ltd., Shenzhen (CN)

(72) Inventor: Shaofeng Xu, Segrate (IT)

(73) Assignee: Huawei Technologies Co., Ltd., Shenzhen (CN)

( * ) Notice: Subject to any disclaimer, the term of this patent is extended or adjusted under 35 U.S.C. 154(b) by 121 days.

(21) Appl. No.: 14/986,289

(22) Filed: Dec. 31, 2015

(65) Prior Publication Data

US 2016/0118702 A1 Apr. 28, 2016

Related U.S. Application Data

(63) Continuation of application No. PCT/CN2013/078840, filed on Jul. 4, 2013.

(51) Int. Cl.
*H01P 1/208* (2006.01)
*H01P 1/207* (2006.01)

(52) U.S. Cl.
CPC ..... *H01P 1/208* (2013.01); *H01P 1/207* (2013.01)

(58) Field of Classification Search
CPC ..... H01P 1/208; H01P 1/207
USPC ..... 333/17.1
See application file for complete search history.

(56) References Cited

U.S. PATENT DOCUMENTS 3,130,380 A * 4/1964 Bowman ..... H01P 1/208 333/212
3,715,690 A * 2/1973 Young ..... H03H 7/0123 333/17.1
5,808,528 A 9/1998 Griffith et al.
2004/0017272 A1 1/2004 Smith et al.
2009/0280991 A1 11/2009 Yamanaka et al.
2012/0126914 A1 5/2012 Miyamoto et al.
2012/0169435 A1 7/2012 Kaneda et al.

FOREIGN PATENT DOCUMENTS

CN 201859933 U 6/2011
CN 102804484 A 11/2012
CN 102945993 A 2/2013
EP 0855757 A2 7/1998
JP 5497348 A 8/1979
JP 2007088545 A 4/2007

OTHER PUBLICATIONS

Vahldieck, R., "Printed High Power E-Plane Filters with Spurious-Free Response," IEEE 16th Annual European Microwave Conference, Sep. 8-12, 1986, 6 pages.

* cited by examiner

*Primary Examiner* — Stephen E Jones
*Assistant Examiner* — Scott S Outten
(74) *Attorney, Agent, or Firm* — Slater Matsil, LLP

(57) ABSTRACT

A filter includes a top panel, a bottom panel, two first side panels located between the top panel and the bottom panel, and at least one diaphragm that has a metal surface. The two first side panels, the top panel and the bottom panel form a rectangular waveguide. The at least one diaphragm is connected to both the top panel and the bottom panel and separates a cavity of the rectangular waveguide into several cavity chambers that extend along an input/output direction of the rectangular waveguide. At least one of the first side panels is an adjustable side panel whose position relative to the diaphragm is adjustable.

20 Claims, 6 Drawing Sheets

FILTER, COMMUNICATIONS APPARATUS, AND COMMUNICATIONS SYSTEM

This application is a continuation of International Application No. PCT/CN2013/078840, filed on Jul. 4, 2013, which is hereby incorporated by reference in its entirety.

TECHNICAL FIELD

The present invention relates to the field of radio communications technologies, and in particular, to a filter, a communications apparatus, and a communications system.

BACKGROUND

A microwave filter is a type of lossless two-port network that is widely applied to microwave communication, radar, electronic countermeasure, and a microwave measurement instrument. The microwave filter is used to control a frequency response of a signal in a system, so that frequency component of a wanted signal passes through the filter almost without attenuation, and transmission of frequency component of an unwanted signal is blocked.

With development of modern microwave communication, in particular, satellite communication and mobile communication, the system has a higher selection of a path. As the microwave filter is an important part in a communications system, performance of the microwave filter determines quality of the whole communications system.

As shown in FIG. 1, an existing microwave filter generally includes a rectangular waveguide 31 and a diaphragm 12 that is metallic at least on the surface and is vertically disposed in the rectangular waveguide 31, where the diaphragm 12 is located between an input port 31*a* and an output port 31*b* of the rectangular waveguide 31 and has at least one window 15, and the window 15 of the diaphragm 12 and a surrounding cavity of the window 15 form a series of resonant units. The input port of the rectangular waveguide refers to a port through which a signal is inputted to the rectangular waveguide, and the output port refers to a port through which a signal is outputted from the rectangular waveguide (for example, if the rectangular waveguide is a rectangular waveguide in a microwave filter, the signal is a microwave signal). The microwave filter is generally corresponding to only a fixed operating band. If an operating band required by an existing network changes and does not suit the fixed operating band of the microwave filter, the system can work normally only by replacing with a suitable device, and therefore, device costs are relatively high.

SUMMARY

Embodiments of the present invention provide a filter, a communications apparatus, and a communications system, to reduce device costs.

According to a first aspect of the present invention, a filter includes a top panel, a bottom panel, and two first side panels located between the top panel and the bottom panel. The two first side panels and parts, which are of the top panel and the bottom panel and are located between the two first side panels, form a first rectangular waveguide. The filter also includes at least one diaphragm that has a metal surface and is connected to both the top panel and the bottom panel and separates a cavity of the first rectangular waveguide into several cavity chambers that extend along an input/output direction of the first rectangular waveguide. At least one of the first side panels is an adjustable side panel whose position relative to the diaphragm is adjustable.

In one possible implementation manner of the first aspect, both of the two first side panels are adjustable side panels whose positions relative to the diaphragm is adjustable.

In one possible implementation manner of the first aspect, the at least one diaphragm that has a metal surface is vertically disposed between the top panel and the bottom panel.

In one possible implementation manner of the first aspect, the filter further includes: two second side panels each disposed outside of the two first side panels, where the two second side panels, the top panel, and the bottom panel form a second rectangular waveguide.

In one possible implementation manner of the first aspect, the at least one diaphragm is vertically disposed at a central position of the second rectangular waveguide.

In one possible implementation manner of the first aspect, the adjustable side panels whose spacing relative to the diaphragm is adjustable are piston side panels.

In one possible implementation manner of the first aspect, the filter further includes: a piston rod connected to the outside of each piston side panel, and a drive apparatus that drives each piston side panel and the piston rod connected to the outside of each piston side panel to move.

In one possible implementation manner of the first aspect, the filter further includes: a controller that has a signal connection to the drive apparatus, configured to control, according to an entered operating band of the filter and a stored correspondence between an operating band of the filter and positions of the two piston side panels, the drive apparatus to drive the two piston side panels to move into a range of a first target position.

In one possible implementation manner of the first aspect, the filter further includes a detector apparatus configured to detect output power of the filter, disposed at an output end of the second rectangular waveguide. The controller has a signal connection to the detector apparatus and is configured to, when the output power of the filter is less than a set power threshold, control the drive apparatus to drive the two piston side panels to move into a range of a second target position.

In one possible implementation manner of the first aspect, the detector apparatus is a detector diode.

In one possible implementation manner of the first aspect, the drive apparatus includes two stepper motors, and each stepper motor correspondingly drives one piston side panel and a piston rod connected to the outside of the piston side panel; or the drive apparatus includes one stepper motor, and the stepper motor simultaneously drives two piston side panels and a piston rod connected to the outside of each of the piston side panels.

In the technical solution of the embodiment of the present invention, when a position of an adjustable side panel is adjusted, an operating band of a filter changes. Adjustment of the operating band of the filter may be achieved by merely adjusting the position of the adjustable side panel, without a need of replacing a related device, and therefore, this solution greatly reduces device costs compared with the prior art.

According to a second aspect of the present invention, a communications apparatus is provided, including the filter according to any one of the foregoing possible implementation manners. Because an operating band of the filter is adjustable and device costs are relatively low, the communications apparatus also has relatively low device costs.

According to a third aspect of the present invention, a communications system is provided, including the communications apparatus according to the foregoing embodiment.

Because an operating band of a filter in the communications apparatus is adjustable and device costs are relatively low, the communications system also has relatively low device costs.

DETAILED DESCRIPTION OF ILLUSTRATIVE EMBODIMENTS

To reduce device costs of a filter, an embodiment of the present invention provides a filter. In this technical solution, two first side panels and parts that are of a top panel and a bottom panel and are located between the two first side panels form a first rectangular waveguide, at least one diaphragm that has a metal surface is connected to both the top panel and the bottom panel and separates a cavity of the first rectangular waveguide into several cavity chambers that extend along an input/output direction of the first rectangular waveguide, and at least one of the first side panels is an adjustable side panel whose position relative to the diaphragm is adjustable. Adjustment of an operating band of a filter may be achieved by merely adjusting a position of an adjustable side panel, without a need of replacing a related device. Therefore, this solution greatly reduces device costs compared with the prior art. To make the objectives, technical solutions, and advantages of the present invention more comprehensible, the following further describes the present invention in detail by using specific embodiments.

A specific type of the filter provided in this embodiment of the present invention is not limited. For example, the filter may be a microwave filter or a radio frequency filter. The microwave filter is a filter that works in a microwave frequency band (that is, 300 MHz-300 GHz). The radio frequency filter is also referred to as a radio frequency interference filter and is mainly used in an electronic device that works in a high frequency (a valid filter frequency ranging from several KHz to over GHz) and is used to greatly attenuate a high-frequency interference signal generated by a high-frequency electronic device.

Figure 2A:
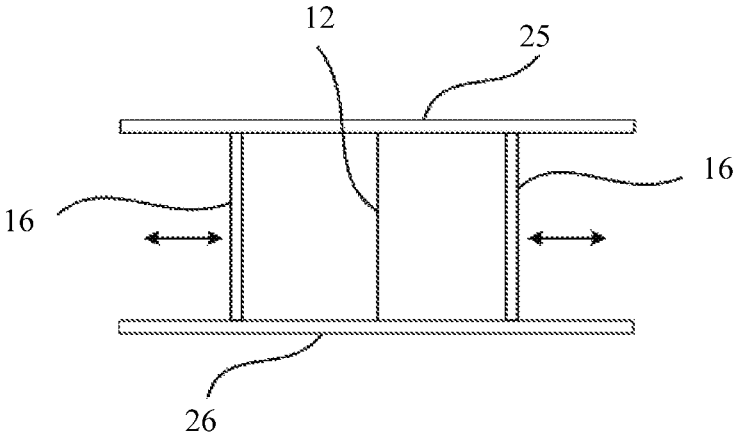
FIG. 2*a* is a schematic diagram of a longitudinal section according to a first embodiment of a filter in the present invention.

As shown in FIG. 2*a*, a filter in a first embodiment of the present invention includes a top panel 25, a bottom panel 26, and two first side panels 16 located between the top panel 25 and the bottom panel 26, where the two first side panels 16, and parts that are of the top panel 25 and the bottom panel 26 and are located between the two first side panels 16 form a first rectangular waveguide.

At least one diaphragm 12 that has a metal surface. The at least one diaphragm 12 is connected to both the top panel 25 and the bottom panel 26 and separates a cavity of the first rectangular waveguide into several cavity chambers that extend along an input/output direction of the first rectangular waveguide. At least one of the first side panels 16 is an adjustable side panel whose position relative to the diaphragm 12 is adjustable.

In a structure of the filter, the diaphragm is generally in a shape of a thin film, and a definition of the diaphragm is also derived thereof. The diaphragm is generally made of a metal material, or may be obtained after surface metallization is performed on a thin diaphragm of another material. The diaphragm 12 separates the cavity of the rectangular waveguide into the several cavity chambers that extend along the input/output direction of the first rectangular waveguide. As shown in FIG. 2*a*, one diaphragm separates the cavity of the rectangular waveguide into two cavity chambers. Each cavity chamber includes a part of the top panel, a part of the bottom panel, the diaphragm, and one side panel, and extends along the input/output direction of the first rectangular waveguide.

Because an extension direction of the side panel is also consistent with the input/output direction of the first rectangular waveguide, it may also be considered that the diaphragm separates the cavity of the rectangular waveguide into the several cavity chambers that extend along the input/output direction of the first rectangular waveguide. Specifically, a quantity (for example, X) of diaphragms and a quantity (for example, Y) of separated cavity chambers meet a relational expression: $Y=X+1$, where both X and Y are positive integers. The rectangular waveguide is a regular metal waveguide that is made of a metal material, has a rectangular cross section, and is filled with an air medium inside, and is one of the most commonly used transmission devices in a microwave technology. The rectangular waveguide has a simple structure and great mechanical strength, may avoid external interference and a radiation loss, and has features of a low conductor loss and a high power capacity. The rectangular waveguide is commonly used as a transmission line or to form a microwave component in a current high/middle-power microwave system.

Figure 3:
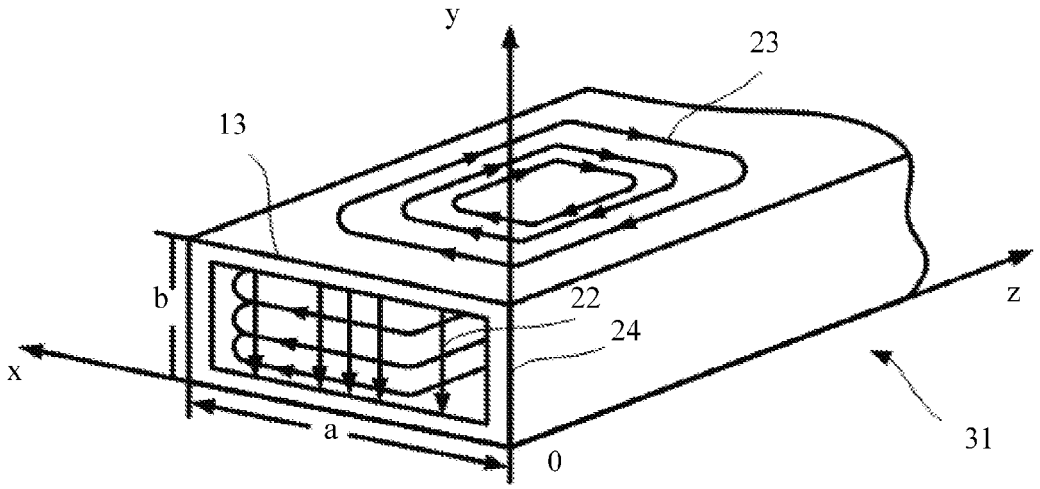
FIG. 3 is a schematic structural diagram of a rectangular waveguide and a schematic diagram of field distribution of the rectangular waveguide.

FIG. 3 shows a common rectangular waveguide. A size of a broad side 13 of a rectangular waveguide 31 is a, a size of a narrow side 24 is b, an input/output direction is set to a direction along a Z axis. Referring to a placement direction of the rectangular waveguide in the diagram, two panel surfaces (parallel to an XZ plane) in which two broad sides 13 are located are respectively defined as a bottom panel and a top panel, two panel surfaces (parallel to a YZ plane) in which two narrow sides 24 are located are defined as side panels, and two end surfaces (parallel to an XY plane) along an input/output direction are respectively defined as an input end surface and an output end surface.

FIG. 3 also shows magnetic field distribution and electric field distribution of the rectangular waveguide. An electric field line 22 and a magnetic field line 23 are orthogonal, and a stronger electric field exists at a position closer to a central position of the broad side 13 of the rectangular waveguide. Generally, in the rectangular waveguide, a plane parallel to a magnetic field direction is referred to as an H plane, and a plane parallel to an electric field direction is referred to as an E plane.

In a preferred embodiment of the present invention, the at least one diaphragm 12 that has a metal surface is vertically disposed, that is, the diaphragm 12 is disposed on the E plane. This type of filter is also referred to as an E-plane waveguide filter, a structure design of the E-plane waveguide filter is simpler, and a standing wave characteristic of the filter is more easily controlled. Several windows are arranged on the diaphragm 12 and are used to form a resonant unit. Preferably, the diaphragm is disposed on the E plane parallel to the side panel.

Generally, a cavity size of a rectangular waveguide is one of the important factors that affect an operating band of a filter, and the present invention uses this principle to achieve band adjustment of the filter. In the technical solution of the present invention, when a position of an adjustable side panel is adjusted, the operating band of the filter changes. Adjustment of the operating band of the filter may be achieved by merely adjusting the position of the adjustable side panel, without a need of replacing a related device, and therefore, this solution greatly reduces device costs compared with the prior art.

In an embodiment of the filter in the present invention, only one of the two first side panels 16 may be an adjustable side panel whose position relative to the diaphragm 12 is adjustable, and in this way, the adjustment of the operating band of the filter may be achieved. However, preferably, both of the two first side panels 16 are adjustable side panels whose positions relative to the diaphragm 12 are adjustable. In this way, both of the two first side panels 16 may be adjusted, so that the filter obtains a better port standing wave characteristic (a port standing wave is a key indicator for measuring performance of a filter and reflects a matching degree between a filter component and another part in a system).

Figure 1:
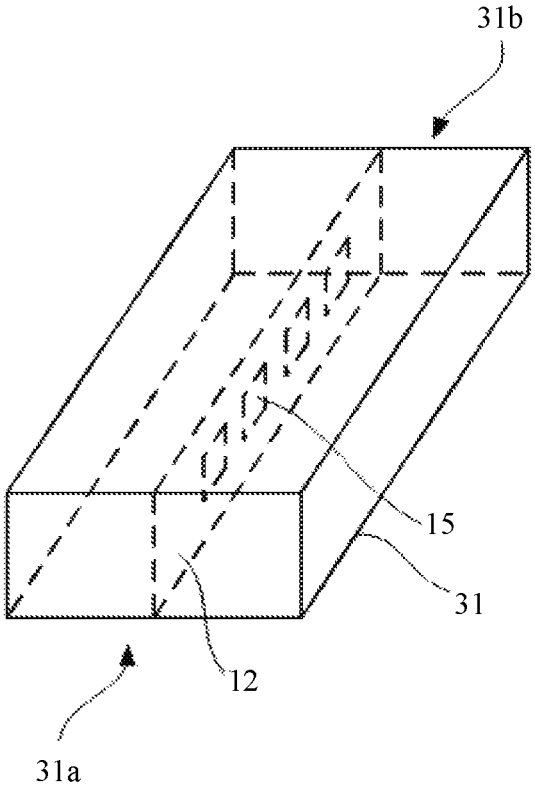
FIG. 1 PRIOR ART
FIG. 1 is a schematic diagram of a three-dimensional structure of an existing microwave filter.
Figure 2B:
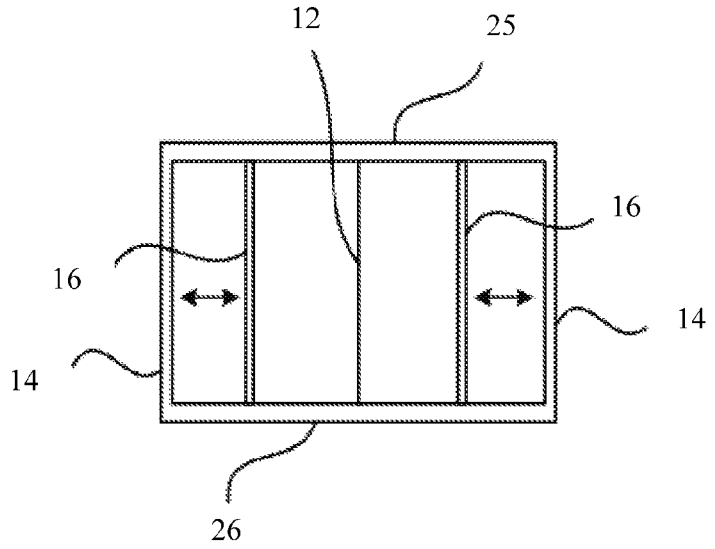
FIG. 2*b* is a schematic diagram of a longitudinal section according to a second embodiment of a filter in the present invention.

As shown in FIG. 2*b*, in a second embodiment of the present invention, the filter further includes: two second side panels 14 each disposed outside of the two first side panels 16, where the two second side panels 14, the top panel 25, and the bottom panel 26 form a second rectangular waveguide. In this embodiment, the filter may be produced by retrofitting an existing filter (for example, the filter shown in FIG. 1), and only an adjustable side panel needs to be added to a cavity of a rectangular waveguide of the existing filter, and therefore, retrofitting costs are relatively low. In this embodiment, when the filter works, a structure involved in a filtering function includes: the first rectangular waveguide formed by the two first side panels 16, and the parts that are of the top panel 25 and the bottom panel 26 and are located between the two first side panels 16, and the diaphragm 12 disposed in the first rectangular waveguide. A cavity between the first side panel 16 and an adjacent second side panel 14 provides only moving space for an adjustable side panel, and makes no contribution to filtering work.

A specific structure form for implementing position adjustment of an adjustable side panel is not limited. For example, multiple groups of positions each having two opposite positions may be set on the top panel 25 and the bottom panel 26, and the adjustable side panel is disposed on one group of position in the multiple groups of positions, and adjustment of the position relative to the diaphragm 12 may be achieved by changing a position of the adjustable side panel. Preferably, the adjustable side panel is a piston side panel. In this way, the position adjustment of the adjustable side panel is more flexible, and an operation is also more convenient.

A quantity of diaphragms 12 is not limited, for example, may be one or two, and a quantity of windows included in each diaphragm 12 and a specific size of a window are also not limited. All the foregoing may be obtained by means of accurate calculation and simulation according to the prior art combined with an actual requirement. Preferably, the at least one diaphragm 12 is vertically disposed at a central position of the second rectangular waveguide. In the embodiment shown in FIG. 2*b*, the quantity of diaphragms 12 is one, and the diaphragm 12 is located at a central position of a broad side of the second rectangular waveguide, that is, a cavity of the second rectangular waveguide is separated into two equally sized sub-cavities. Because the central position of the broad side of the rectangular waveguide generally has a strongest electric field, the diaphragm 12 is disposed at this position to obtain a better port standing wave characteristic of the filter.

In the embodiments of the present invention, all the top panel 25, the bottom panel 26, the first side panel 16, and the second side panel 14 are made of metal materials, and the metal materials are preferably aluminum materials, or may be copper materials, or the like. When the adjustable side panel is a piston side panel, a drive manner of the adjustable side panel is not limited. For example, two piston side panels may be manually adjusted to a range of a first target position according to a correspondence list that is between operating bands of the filter and positions of the two piston side panels and is obtained by means of pre-calculation, or the driving may be implemented by using a drive apparatus.

Figure 4:
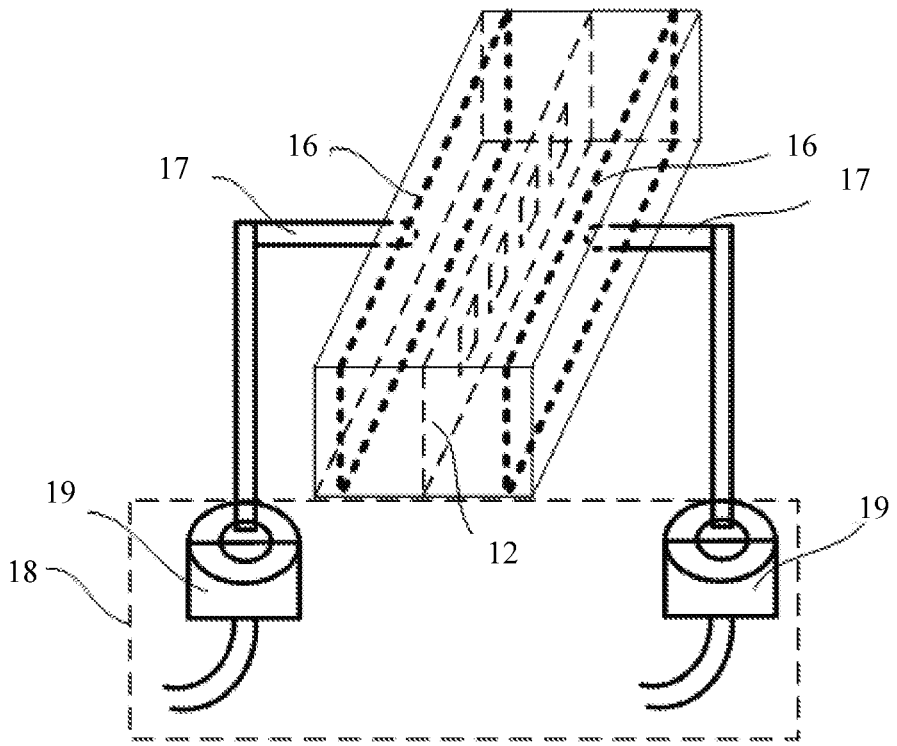
FIG. 4 is a schematic diagram of a three-dimensional structure according to a third embodiment of a filter in the present invention.

In an embodiment shown in FIG. 4, the filter further includes: a piston rod 17 connected to the outside of each piston side panel, and a drive apparatus 18 that drives each piston side panel and the piston rod 17 connected to the outside of each piston side panel to move. Displacement of the piston side panel may be controlled more accurately by driving, by the drive apparatus 18, the piston side panel to move, so that band adjustment of the filter is more accurate, and an operation is more convenient.

A specific form of the drive apparatus 18 is not limited, and the drive apparatus 18 may drive the piston side panels at two sides to synchronously move, or may drive the piston side panels at two sides to separately move. For example, in an embodiment, the drive apparatus 18 includes two stepper motors 19, and each stepper motor 19 correspondingly drives one piston side panel and a piston rod 17 connected to the outside of the piston side panel, as shown in FIG. 4. However, preferably the drive apparatus 18 includes one stepper motor 19, and the stepper motor 19 simultaneously drives two piston side panels and a piston rod 17 connected to the outside of each of the piston side panels. In this way, moving distances of the two piston side panels to the diaphragm 12 are consistent, and cavities at two sides of the diaphragm 12 are constantly equal, so that the filter obtains a better port standing wave characteristic.

Figure 5:
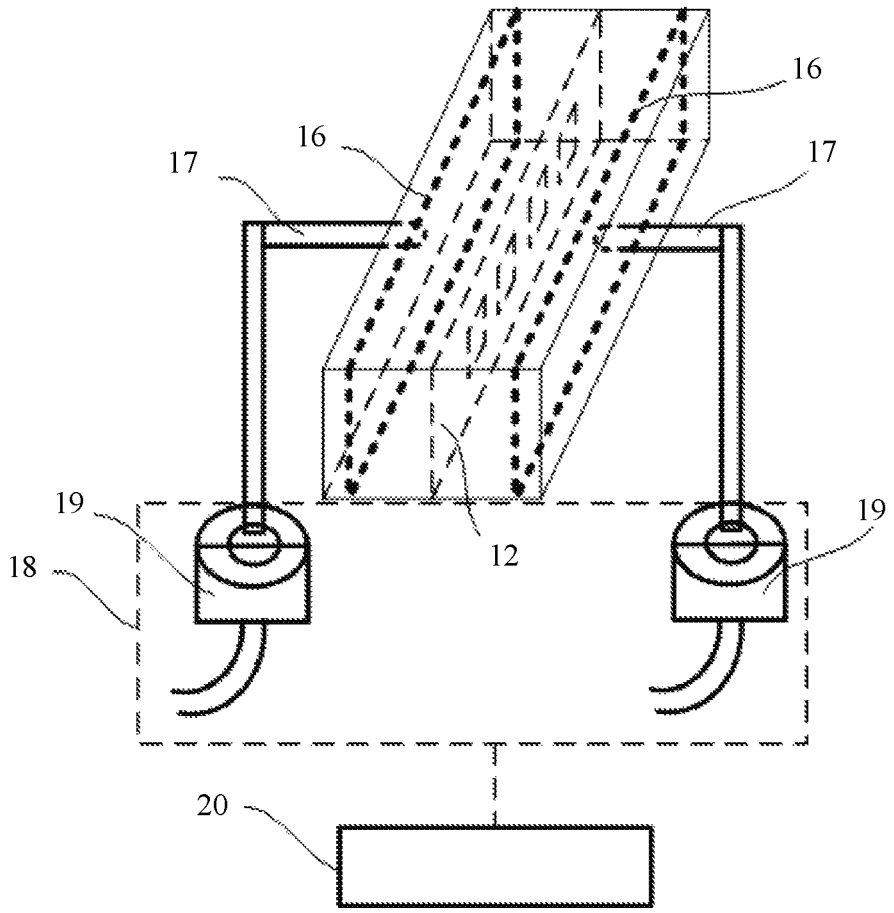
FIG. 5 is a schematic diagram of a three-dimensional structure according to a fourth embodiment of a filter in the present invention.

As shown in FIG. 5, in this embodiment, the filter further includes: a controller 20 that has a signal connection to the drive apparatus 18, configured to control, according to an entered operating band of the filter and a stored correspondence between an operating band of the filter and positions of the two piston side panels, the drive apparatus 18 to drive the two piston side panels to move into the range of the first target position.

When the two piston side panels are located in the range of the first target position, an operating band of the filter can meet a work requirement, and in this case, there is no need to accurately locate the piston side panel at an exact position. Therefore, in this embodiment, adjustment precision of the filter is fully considered, a filter whose costs suit adjustment precision may be designed according to an actual requirement, and adjustment is performed in a more convenient manner. The correspondence between an operating band of the filter and positions of the two piston side panels may be obtained according to the prior art and by means of previous simulation calculation or previous statistics collection of related experiments. When it is required to adjust an operating band of the filter, only a value of the operating band needs to be entered. Therefore, an operation step of an operator is greatly simplified, operation efficiency is improved, and in addition, accuracy is relatively high. A specific type of the controller 20 is not limited. For example, a programmable controller may be selected for use. In addition, the correspondence between an operating band of the filter and positions of the two piston side panels may be represented in multiple manners, such as a relational expression for a function, or a correspondence data list.

Figure 6:
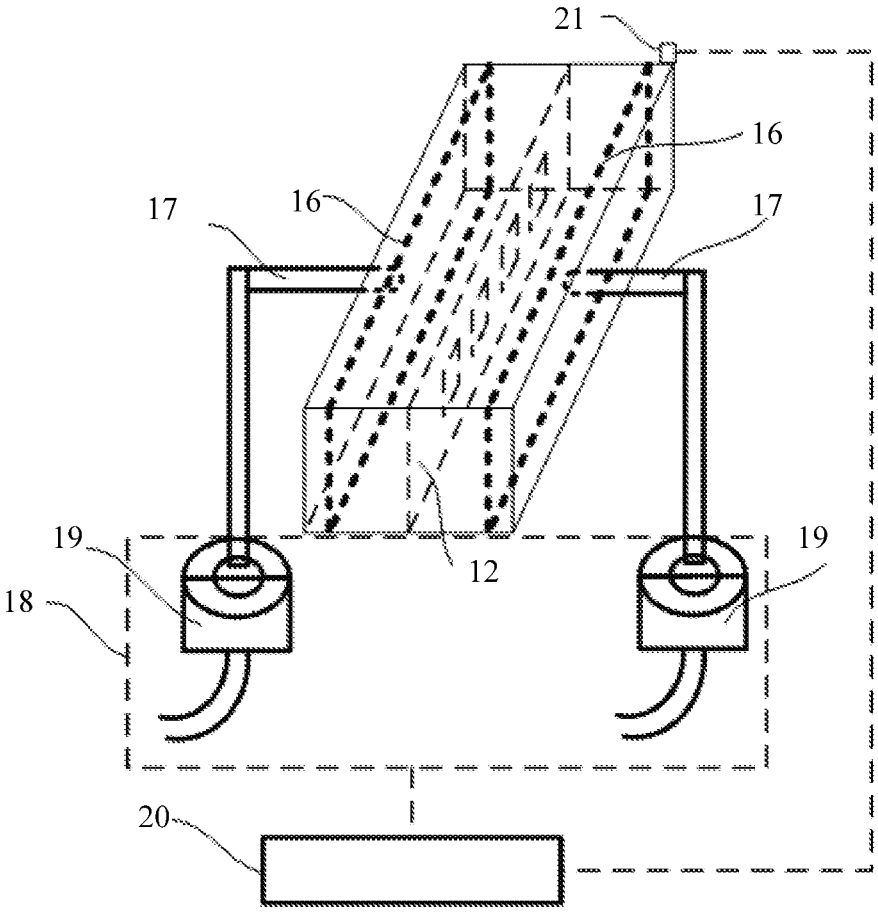
FIG. 6 is a schematic diagram of a three-dimensional structure according to a fifth embodiment of a filter in the present invention.

As shown in FIG. 6, preferably, band adjustment control of a filter may be designed as an adaptive closed-loop control system. The filter further includes a detector apparatus 21, which is configured to detect output power of the filter and disposed at an output end of the second rectangular waveguide. The controller 20 has a signal connection to the detector apparatus 21 and is configured to, when the output power of the filter is less than a set power threshold, control the drive apparatus 18 to drive the two piston side panels to move into a range of a second target position.

The range of the second target position is corresponding to an allowed range of the output power, and when an operating band of the filter changes, the output power of the filter also correspondingly changes. Therefore, a change status of the operating band of the filter may be obtained by detecting the output power of the filter. When the output power of the filter is less than the set power threshold, it indicates that a changed operating band of the filter does not suit a requirement. In this case, the controller 20 controls the drive apparatus 18 to adjust the two piston side panels to move into the range of the second target position.

A specific type of the detector apparatus 21 is not limited, so long as the output power of the filter can be detected. For example, the detector apparatus 21 may be a detector diode. In this embodiment, by adding a feedback step of performing automatic correction and compensation on band adjustment control of the filter, it is easily to achieve adaptive band adjustment, which helps improve precision and stability of a control system.

Figure 7:
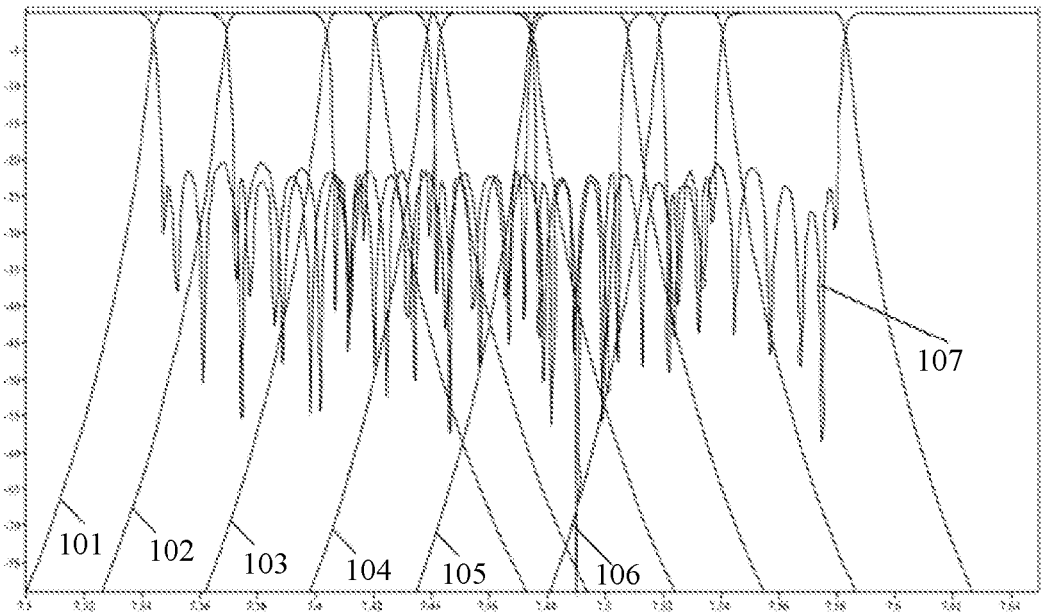
FIG. 7 is a schematic diagram of frequency response curves of a filter when a piston side panel is located at different positions.

A microwave filter is used as an example. For a frequency response curve of the microwave filter when the piston side panel is located at different positions, reference is made to FIG. 7. It may be seen from the diagram that when a position of the piston side panel is adjusted, a passband frequency response of the microwave filter correspondingly changes. The position of the piston side panel is constantly changed to achieve an objective of constantly adjusting the frequency response of the microwave filter. In addition, the microwave filter has a better port standing wave characteristic curve in each operating band (the diagram merely exemplarily shows that when the piston side panel is located at different positions, six operating bands of the microwave filter are respectively corresponding to frequency response curves 101-106).

In the filter provided in this embodiment of the present invention, a production method of the filter may include: installing a diaphragm between a top panel and a bottom panel, and adjustable side panels located at two sides of the diaphragm; or retrofitting adjustable side panels in a rectangular waveguide of an existing filter and at two sides of a diaphragm. This production process may be manually implemented, or may be automatically implemented by an electric device by using a control program.

An embodiment of the present invention further provides a communications apparatus, including the filter described in any one of the foregoing embodiments. Because an operating band of the filter is adjustable and device costs are relatively low, the communications apparatus also has relatively low device costs.

A specific type of the communications apparatus is not limited. For example, the communications apparatus may be an ODU (Outdoor Unit), a satellite communication apparatus, a base-station communication apparatus, a broadcast communication apparatus, or a radio-station communication apparatus.

In addition, an embodiment of the present invention further provides a communications system, including the communications apparatus described in the foregoing embodiment. Because an operating band of a filter in the communications apparatus is adjustable and device costs are relatively low, the communications system also has relatively low device costs.

Mutual reference may be made between the embodiments provided in the present invention.

Based on the foregoing descriptions of the implementation manners, a person skilled in the art may clearly understand that the present invention may be implemented by software in addition to necessary universal hardware or by hardware only. In most circumstances, the former is a preferred implementation manner. Based on such an understanding, the technical solutions of the present invention essentially or the part contributing to the prior art may be implemented in a form of a software product. The software product is stored in a readable storage medium, such as a floppy disk, a hard disk or an optical disc of a computer, and includes several instructions for instructing a computer device (which may be a personal computer, a server, or a network device) to perform the methods described in the embodiments of the present invention.

Obviously, a person skilled in the art can make various modifications and variations to the present invention without departing from the spirit and scope of the present invention. The present invention is intended to cover these modifications and variations provided that they fall within the scope of protection defined by the following claims and their equivalent technologies.

What is claimed is:

1. A filter, comprising:

a top panel, a bottom panel, and two first side panels, wherein the two first side panels are located between the top panel and the bottom panel, and wherein the two first side panels, the top panel and the bottom panel form a first rectangular waveguide;

a diaphragm that has a metal surface, wherein the diaphragm is connected to both the top panel and the bottom panel, and wherein the diaphragm separates a cavity of the first rectangular waveguide into a plurality of cavity chambers that extend along an input/output direction of the first rectangular waveguide, wherein a side panel of the two first side panels is an adjustable side panel having a position relative to the diaphragm that is adjustable; and two second side panels, each of the second side panels being disposed outside of the two first side panels in a manner that the two first side panels are disposed between the two second side panels, wherein the two second side panels, the top panel, and the bottom panel form a second rectangular waveguide.

2. The filter according to claim 1, wherein both of the two first side panels are adjustable side panels having positions relative to the diaphragm that are adjustable.

3. The filter according to claim 2, further comprising:

two rods, wherein each rod is respectively connected to an outside surface of one of the first side panels; and a driver, configured to cause each of the first side panels and each of the rods to move.

4. The filter according to claim 3, further comprising a controller that has a signal connection to the driver, the controller being configured to control the driver to cause the two first side panels to move into a range of a first target position according to an entered operating band of the filter and a stored correspondence between an operating band of the filter and positions of the two first side panels.

5. The filter according to claim 4, further comprising a power detector disposed at an output end of the second rectangular waveguide to detect output power of the filter, wherein the controller has a signal connection to the power detector to control the driver to cause the two first side panels to move into a range of a second target position when the output power of the filter is less than a set power threshold.

6. The filter according to claim 5, wherein the power detector comprises a detector diode.

7. The filter according to claim 3, wherein the driver comprises two stepper motors, each stepper motor being configured to move a corresponding one of the two first side panels and one of the rods connected to the outside of the corresponding one of the two first side panels.

8. The filter according to claim 3, wherein the driver comprises a single stepper motor that is configured to simultaneous drive the two first side panels and the rods connected to the outside of the two first side panels.

9. The filter according to claim 1, wherein the diaphragm is vertically disposed between the top panel and the bottom panel.

10. The filter according to claim 1, wherein the diaphragm is vertically disposed at a central position of the second rectangular waveguide.

11. A communications apparatus, comprising a filter that comprises:

a top panel, a bottom panel, and two first side panels, wherein the two first side panels are located between the top panel and the bottom panel, wherein the two first side panels, the top panel and the bottom panel form a first rectangular waveguide;

a diaphragm that has a metal surface, wherein the diaphragm is connected to both the top panel and the bottom panel, and wherein the diaphragm separates a cavity of the first rectangular waveguide into a plurality of cavity chambers that extend along an input/output direction of the first rectangular waveguide, wherein a side panel of the two first side panels is an adjustable side panel having a position relative to the diaphragm that is adjustable; and two second side panels, each of the second side panel being disposed outside of the two first side panels in a manner that the two first side panels are disposed between the two second side panels, where the two second side panels, the top panel, and the bottom panel form a second rectangular waveguide.

12. The communications apparatus according to claim 11, wherein both of the two first side panels are adjustable side panels having positions relative to the diaphragm that are adjustable.

13. The communications apparatus according to claim 12, further comprising:

two rods, wherein each rod is respectively connected to an outside surface of one of the first side panels; and a driver, configured to cause each of the first side panels and each of the rods to move.

14. The communications apparatus according to claim 13, further comprising a controller that has a signal connection to the driver, the controller configured to control the driver to cause the two first side panels to move into a range of a first target position according to an entered operating band of the filter and a stored correspondence between an operating band of the filter and positions of the two first side panels.

15. The communications apparatus according to claim 14, further comprising a power detector disposed at an output end of the second rectangular waveguide to detect output power of the filter, wherein the controller has a signal connection to the power detector to control the driver to cause the two first side panels to move into a range of a second target position when the output power of the filter is less than a set power threshold.

16. The communications apparatus according to claim 15, wherein the power detector comprises a detector diode.

17. The communications apparatus according to claim 13, wherein the driver comprises two stepper motors, each stepper motor being configured to move a corresponding one of the two first side panels and one of the two rods connected to the outside of the corresponding one of the two first side panels.

18. The communications apparatus according to claim 13, wherein the driver comprises a single stepper motor that is configured to simultaneously drive the two first side panels and the two rods connected to the outside of the two first side panels.

19. The communications apparatus according to claim 11, wherein the diaphragm is vertically disposed between the top panel and the bottom panel.

20. The communications apparatus according to claim 11, wherein the diaphragm is vertically disposed at a central position of the second rectangular waveguide.

* * * * *